US005483883A

United States Patent [19]

Hayama

[11] Patent Number: 5,483,883

[45] Date of Patent: Jan. 16, 1996

[54] METHOD FOR IMAGING A STENCIL USING A LOW ENERGY LASER AND LIGHT ABSORBING INK

[75] Inventor: Noboru Hayama, Minato, Japan

[73] Assignee: Riso Kagaku Corporation, Tokyo, Japan

[21] Appl. No.: 128,728

[22] Filed: Sep. 30, 1993

[30] Foreign Application Priority Data

Oct. 16, 1992 [JP] Japan ..... 4-304725

[51] Int. Cl.[6] ..... B41F 15/08; B41N 1/24

[52] U.S. Cl. ..... 101/128.4; 101/119; 101/128.21

[58] Field of Search ..... 101/116–120, 128.21, 101/128.4, 129, 401.1, 467, 481, 485, 486, DIG. 36, DIG. 46

[56] References Cited

U.S. PATENT DOCUMENTS

| | | | |
|---|---|---|---|
| 3,964,389 | 6/1976 | Peterson | 101/467 |
| 4,395,946 | 8/1983 | Price | 101/401.1 |
| 4,503,458 | 3/1985 | Karaki | 358/502 |
| 4,526,098 | 7/1985 | Bachman | 101/128.4 |
| 4,718,340 | 1/1988 | Love, III | 101/116 |
| 4,911,069 | 3/1990 | Hayama et al. | 101/120 |
| 4,944,826 | 7/1990 | Zollman et al. | 101/128.21 |
| 4,947,749 | 8/1990 | Lewis et al. | 101/467 |
| 5,140,898 | 8/1992 | Igarashi | 101/120 |
| 5,186,102 | 2/1993 | Kanno et al. | 101/128.4 |
| 5,224,419 | 7/1993 | Fukai | 101/128.4 |
| 5,243,906 | 9/1993 | Okusawa | 101/128.4 |
| 5,252,838 | 10/1993 | Timblin | 101/115 |
| 5,339,737 | 8/1994 | Lewis et al. | 101/454 |

FOREIGN PATENT DOCUMENTS

| | | | |
|---|---|---|---|
| 2258265 | 8/1975 | France . | |
| 4038675 | 6/1991 | Germany . | |
| 48-46417 | 7/1973 | Japan . | |
| 52-136019 | 11/1977 | Japan . | |
| 53-9521 | 1/1978 | Japan . | |
| 54-136318 | 10/1979 | Japan . | |
| 57-56871 | 12/1982 | Japan . | |
| 60-36956 | 8/1985 | Japan . | |
| 61-229595 | 10/1986 | Japan . | |
| 229595 | 10/1986 | Japan | 101/128.4 |
| 33689 | 2/1987 | Japan | 101/128.4 |
| 62-181150 | 8/1987 | Japan . | |
| 2225078 | 9/1990 | Japan . | |

*Primary Examiner*—Stephen Funk

*Attorney, Agent, or Firm*—Stevens, Davis, Miller & Mosher

[57] ABSTRACT

A layer of ink containing a light absorbing heat generating substance is provided on the rear surface of a heat-sensitive plastic film of a thermal stencil sheet when the heat-sensitive plastic film is perforated by a laser beam. When a rotary stencil printer is used, a stencil sheet is mounted around a printing drum of the rotary stencil printer in a condition adhesively held by an ink layer, then a laser beam is irradiated to a portion of the stencil sheet to be perforated, and then the printing process is carried out with the stencil sheet as it has been mounted around the printing drum for the perforation.

4 Claims, 4 Drawing Sheets

METHOD FOR IMAGING A STENCIL USING A LOW ENERGY LASER AND LIGHT ABSORBING INK

BACKGROUND OF THE INVENTION

1. Field of the Invention

The present invention relates to the field of stencil printing, and more particularly to a technique of preparing a stencil master by perforating a thermal stencil sheet by a laser beam.

2. Description of the Prior Art

The laser is a technique developed in the 1950's as a technique of expanding the range of the microwave amplification by stimulated emission of radiation (maser) to the range of light wave frequencies, and from the beginning of its development it was known as a technique to be able to melt and cut a large variety of materials by irradiation of a light beam, as the technique makes it possible to generate a light beam having a high energy density. Therefore, as a matter of fundamental function and effect of the laser, it is readily thought of to produce a stencil master by irradiation by use of a laser beam to a heat-sensitive plastic film of a thermal stencil sheet so as thereby locally to perforate such a film.

However, since a laser beam is still a light beam, it passes through a transparent body, and therefore, when a laser beam is irradiated to a thermal stencil sheet made of a heat-sensitive plastic film having a relatively high transparency, most of the laser beam merely passes through the heat-sensitive plastic film. Therefore, in order to apply a heating effect such a thermal stencil sheet by a laser beam sufficient to cause perforation thereof, a laser beam is required to have such an extremely high energy density that the idea is, in fact, far from being applicable to such convenient small sized stencil printing devices for office use.

When an attempt is made to use a black stencil sheet such as disclosed in Japanese Patent Laid-open Publication 48-46417 (Patent No. 841178) filed by the same applicant as the assignee of the present invention) including fine particles of a light absorbing heat generating substance such as carbon distributed in a heat-sensitive plastic film to be perforated by a laser beam, it will be possible to perforate such a stencil sheet into a stencil master by a laser beam having a relatively low energy density. However, in order to produce a fine stencil print by using such a stencil sheet made of a heat-sensitive plastic film containing fine particles of a light absorbing heat generating substance, it is required that the fine particles of the light absorbing heat generating substance be distributed at high density and uniformity in the heat-sensitive plastic film. Nevertheless, since no chemical binding, which is generally a strong binding, is available between solid fine particles such as carbon particles and a heat-sensitive plastic, such fine solid particles are just held in the plastic layer only depending upon a mechanical planting. Therefore, when the density of the fine solid particles is increased, the fine solid particles are not sufficiently held in the plastic layer, and further the continuity of the plastic layer is so much damaged that a film having a uniform thickness is no longer available. Therefore, there is a definite limit in increasing the density of the light absorbing heat generating fine particles mixed in the stencil sheet.

SUMMARY OF THE INVENTION

In view of the above-mentioned problem which appears to definitely impede practical application of a laser beam to the perforation of a stencil sheet, it is a primary object of the present invention to provide a method which makes it easily possible to perforate a conventionally used normal type thermal stencil sheet by a laser beam having a relatively low energy density, and it is also another object of the present invention to provide a stencil printing device incorporating such a new method of stencil perforation.

According to the present invention, the above-mentioned objects are accomplished by a method for perforating a thermal stencil sheet by a laser beam, comprising the steps of positioning a thermal stencil sheet so that a heat-sensitive plastic film thereof faces a source of a laser beam with a first surface thereof while a second surface of the heat-sensitive plastic film opposite to said first surface is supplied with a layer of ink including a light absorbing heat generating substance attached thereto, and irradiating the laser beam from said source to the heat-sensitive plastic film from the side of said first surface, whereby the heat-sensitive plastic film is melted and perforated starting from said second surface by a heat generated in the light absorbing heat generating substance of the ink layer by the laser beam passed through the heat-sensitive plastic film and absorbed by the light absorbing heat generating substance; and a stencil printing device comprising a printing drum having a cylindrical body formed with a large number of through openings and adapted to support a stencil sheet on an outer circumferential surface thereof, an inking roller for supplying ink to an inner circumferential surface of said printing drum, a back press roller arranged in parallel with said printing drum so as to face the outer circumferential surface of said printing drum and to define a nip region therebetween for nipping a print sheet, a rotary drive means for rotating said printing drum, said inking roller and said back press roller in synchronization with one another, a print sheet supply means for supplying a print sheet to said nip region, a stencil sheet supply means for supplying a thermal stencil sheet to the outer circumferential surface of said printing drum, a laser source means adapted to radiate a laser beam toward the outer circumferential surface of said printing drum such that a position of irradiating the laser beam on the outer circumferential surface of said printing drum is movable along a central axis of said printing drum, and a perforation control means adapted to imaginarily develop the outer circumferential surface of said printing drum into a two dimensional matrix defined by a first dimension representing a rotational angle position of said printing drum and a second dimension representing a position of pitch movement of the laser beam and to control operation of said laser source means in synchronization with rotation of said printing drum and pitch movement of the laser beam so that a laser beam is radiated from said laser source means in correspondence with each one of dot positions constructing said two dimensional dot matrix which corresponds to a portion to be inked in a print, respectively.

When a thermal stencil sheet is positioned as described above for perforation thereof by a laser beam such that a first surface of a heat-sensitive plastic film of the stencil sheet faces a source of the laser beam, while a second surface thereof opposite to said first surface is supplied with a layer of ink containing a light absorbing heat generating substance, and the laser beam is irradiated to the heat-sensitive plastic film from the side of said first surface, the laser beam which passes through the heat-sensitive plastic film is absorbed by the light absorbing heat generating substance of the ink layer attached to said second surface of the heat sensitive plastic film, thereby generating heat in the light absorbing heat generating substance, the heat thus generated being directly applied to said second or rear surface of the heat-sensitive plastic film, so that the heat-sensitive plastic film is melted starting from the rear side thereof. In this manner the heat-sensitive plastic film is efficiently formed with clear through openings at portions irradiated by a laser beam having a relatively low energy density such as available by a semiconductor laser device.

In this case, since the ink layer attached to the rear surface of the heat-sensitive plastic film may be used just as it is for the printing after the perforation, it is not necessary to provide any particular material or means only for the purpose of absorbing the laser beam during the perforation of the thermal stencil sheet.

Therefore, the method of perforating a stencil sheet according to the present invention may desirably be carried out by a rotary stencil printing device having a printing drum adapted to support a stencil sheet on an outer circumferential surface thereof and to supply ink to the stencil sheet from a rear surface thereof such that a stencil sheet before perforation is mounted to the outer circumferential surface of the printing drum in a condition adhesively attached thereto by a layer of ink containing a light absorbing heat generating substance, and a laser beam is irradiated to a portion of the stencil sheet to be perforated while the stencil sheet is adhesively held by the ink layer, and then, after the perforation, stencil printing is carried out by the stencil sheet after it is mounted on the printing drum.

When the perforation of a thermal stencil sheet by the laser beam is carried out on the printing drum of a rotary stencil printing device as described above, for the purpose of perforating the stencil sheet, the printing drum supporting the stencil sheet adhesively attached thereon by the ink layer may be rotated, while the position of irradiating the laser beam on the stencil sheet is moved along the central axis of the printing drum, so that the entire region of the stencil sheet can be efficiently perforated by a single laser source means.

When the perforation of a stencil sheet is carried out in the above-mentioned manner, i.e. the stencil sheet adhesively held on a printing drum by an ink layer is irradiated by a laser beam moved along the central axis of the printing drum while the printing drum is rotated, if the printing is a copy of an original, the irradiation of the laser beam to the stencil sheet mounted around the printing drum may be carried out in a manner such that, defining the circumferential orientation of the outer circumferential surface of the printing drum to be a longitudinal orientation of the stencil sheet, the original is moved in the longitudinal direction, while a plurality of dot original read out means arranged in a lateral orientation read out the original by resolving the image of the original into a two dimensional dot matrix, and two dimensional dot matrix image data thus obtained are read out line after line to be progressive in the longitudinal direction in order to operate the laser beam.

In the above-mentioned stencil printing device, the rotary drive means for driving the printing drum, the inking roller and the back press roller in synchronization with one another may include a means to rotate the printing drum at a high rotation speed in a condition that the printing drum is disengaged from synchronization with the inking roller and the back press roller.

When the printing drum is rotated independently, the printing drum can be free of any mechanical contact with other members except bearing means therefor, and therefore the printing drum may be rotated at much higher rotation speed than in the printing, whereby a time required for the perforation of the stencil sheet can be substantially shortened even when the entire region of the stencil sheet is perforated by a single laser source means.

In the above-mentioned stencil printing device, when the stencil printing is carried out by copying an original, an original read out means may desirably be incorporated such that it comprises an original transfer means for transferring a rectangular original having a transverse width according to said second dimension of said two dimensional matrix and a longitudinal length according to said first dimension of said two dimensional matrix, and a plurality of dot original read out means arranged in the transverse direction, whereby the plurality of dot original read out means read out colored portions of the rectangular original at each longitudinal position while the rectangular original is transferred in the longitudinal direction by the original transfer means, so that image data according to said two dimensional matrix is supplied to said perforation control means.

Alternatively, when a stencil printing is carried out by the above-mentioned stencil printing device in a manner of copying an original, an original read out means may be incorporated such that it comprises an original transfer means for transferring a rectangular original having a transverse width according to said second dimension of said two dimensional matrix and a longitudinal length according to said first dimension of said two dimensional matrix in the transverse direction, and a plurality of dot original read out means arranged in the longitudinal direction, whereby the plurality of dot original read out means read out colored portions of the rectangular original at each transverse position of the rectangular original while the rectangular original is transferred in the transverse direction by the original transfer means, so that image data according to said two dimensional matrix is supplied to said perforation control means.

When the above latter mentioned original read out means is incorporated, the data with respect to the colored portions of the original may be supplied to the perforation control means without waiting until all data with respect to the image of the original according to said two dimensional matrix-are read out, so that, when the data with respect to the colored portions-of the original are read out by the plurality of dot original read out means arranged in the longitudinal direction at each transverse position of the original, the data are supplied to the perforation control means so as thereby to start the perforation of the stencil sheet according to such data successively available, whereby the reading out of the original and the perforation are carried out simultaneously, thereby to substantially shorten the time required for copying perforation.

In the above-mentioned stencil printing device, the rotary angle position of the printing drum may be detected by a means to read out a pitch pattern provided along a side edge of the stencil sheet mounted around the outer circumferential surface of the printing drum so as to extend along the circumference of the printing drum. A stencil sheet exclusively used in such a stencil printing device having the above-mentioned rotary read out means :may be provided with a pitch pattern along a side edge thereof for generating a signal indicating the rotary angle position of the printing drum when mounted around the outer circumferential surface of the printing drum by being read out by said read out means.

BRIEF DESCRIPTION OF THE DRAWINGS

In the accompanying drawings.

DESCRIPTION OF THE PREFERRED EMBODIMENTS

In the following the present invention will be described in more detail in the form of some preferred embodiments thereof with reference to the accompanying drawings.

Figure 1:
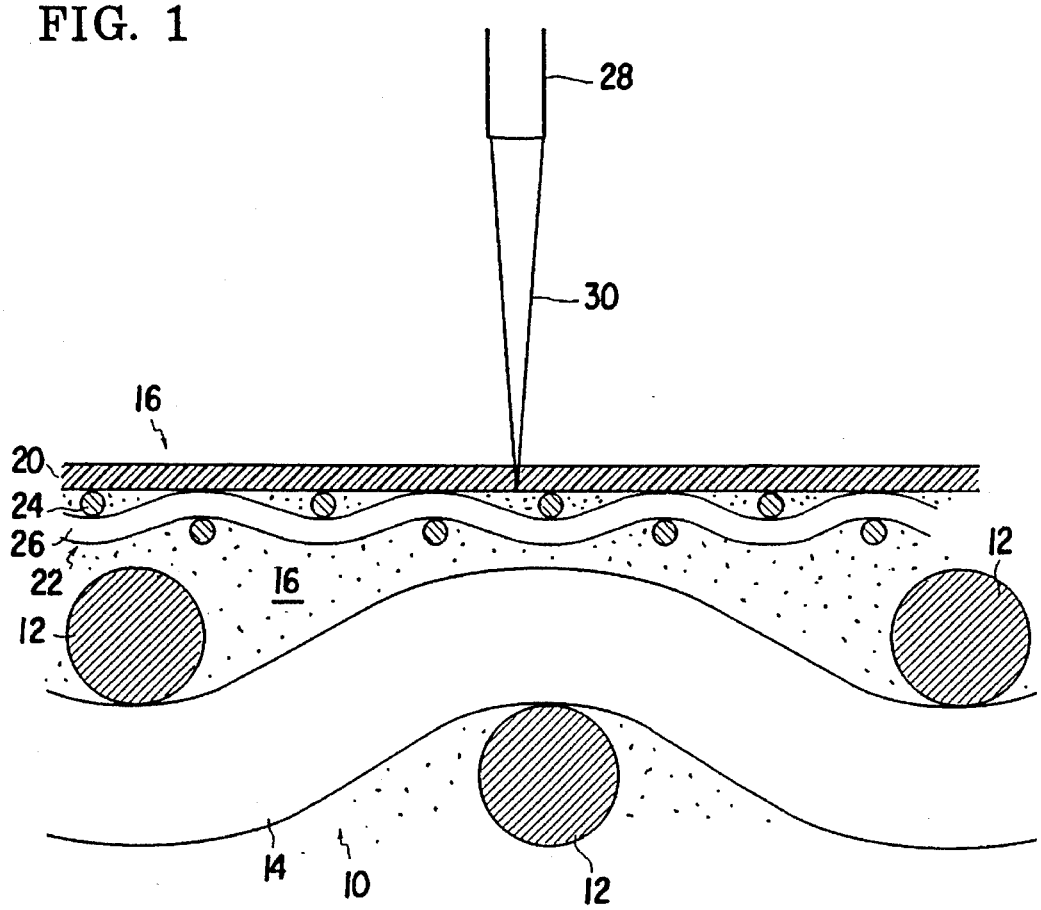
FIG. 1 is a magnified sectional view showing a condition that a thermal stencil sheet is mounted on a printing drum of a rotary stencil printing device having a cylindrical wall made of a net material and is irradiated by a laser beam for perforation.

FIG. 1 is a cross sectional view showing in magnification a state in which a thermal stencil sheet is adhesively held on an outer circumferential surface of a printing drum of a rotary stencil printer by a layer of a black ink containing fine particles of carbon black serving as a coloring material as well as a light absorbing heat generating substance, with a laser beam irradiated to the thermal stencil sheet.

In the shown embodiment, a printing drum partly shown by reference numeral 10 is constructed to have a cylindrical wall made of a net material woven from wire materials as proposed in Japanese Patent Laid-open Publication 1-204781 by the same applicant as the assignee of the present invention, wherein 12 and 14 are longitudinal and transverse wire materials constructing the net material. On the outer circumferential surface of the cylindrical wall made of the net of the printing drum, a thermal stencil sheet 16 is mounted in a condition adhesively held thereto by a layer 18 of a black ink. The thermal stencil sheet 16 has a heat-sensitive plastic film 20 and a net material 22 laid one over the other and bound together, wherein the net material 22 is woven from warp fibers 24 and weft fibers 26. Since a relatively thick layer of ink remains on the outer circumferential surface of the printing drum even after a used stencil sheet has been peeled off after the completion of stencil printing by the stencil sheet, when a new stencil sheet is mounted onto the outer circumferential surface of the printing drum in a manner that it is gradually laid thereon, starting from an end portion thereof, without trapping air therebetween, there is obtained a state that the open spaces between the fibers 24 and 26 constructing the net material 22 are filled with ink sufficiently to provide a condition that the rear surface of the heat-sensitive plastic film 20 is entirely in intimate contact with the ink of the ink layer 18. Or, if the stencil sheet is pressed toward the printing drum accordingly as the stencil sheet is progressively laid on the printing drum or once after the completion of the mounting of the stencil sheet, or ink is slightly extruded by the ink extruding means, the rear surface of the stencil sheet will come into more uniform and definite contact with the ink layer. As a modification, a perforated sheet of a metal or synthetic resin may be used instead of the net material 10 in the figure.

When a laser beam 30 from a laser source means 28 is irradiated to the heat-sensitive plastic film 20 of the stencil sheet backed by the black ink layer 18 attached to the rear surface thereof, most of the laser beam passes through the heat-sensitive plastic film 20 so as to reach the black ink layer 18 and absorbed thereby, such that the temperature of the ink at the irradiated portion rapidly increases, so as thereby to melt and perforate the corresponding portion of the heat-sensitive plastic film, starting from the rear surface thereof.

Figure 2A:
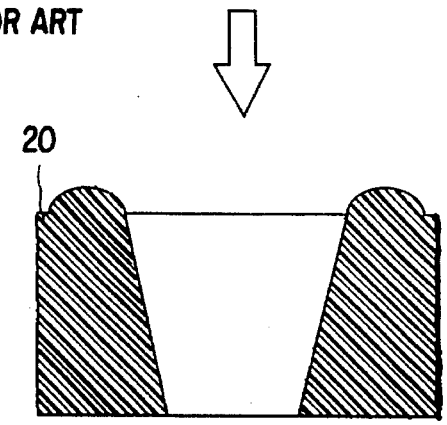
FIG. 2A PRIOR ART
FIG. 2A is a magnified sectional view showing conditions of the bores formed in a heat-sensitive plastic film by a conventional thermal element.
Figure 2B:
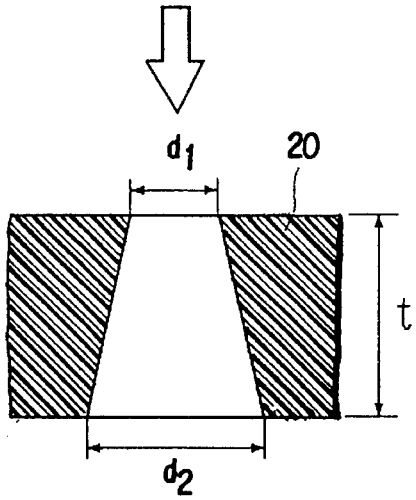
FIG. 2B is a similar sectional view showing a bore formed by a laser beam according to the manner shown in FIG. 1; respectively.

FIG. 2A illustrates in a magnified cross section the condition of perforation formed in a heat-sensitive plastic film 20 of a stencil sheet by a conventional minute thermal element pressed against the heat-sensitive plastic film from its front side, wherein the bore of the perforation has a cone shape having diameter increasing toward the front side. FIG. 2B is a view similar to FIG. 2A, showing the condition of perforation formed in a heat-sensitive plastic film such as 20 backed by a black ink layer such as 18 by a laser beam irradiated from its front side, wherein the perforation formed by the heat-sensitive plastic film is melted by the heat generated in the ink layer existing at the rear side of the plastic film. In this case, as is shown in the figure, the bore of the perforation has a cone shape having a diameter increasing toward the rear side.

According to the experiments conducted by the inventor and his colleague, when a polyester film having 2.0 microns thickness and a thermal shrinkage value of 7.5% according to one minute dip in a silicon oil of 120° C. backed by a layer of an emulsion ink containing carbon black (RISOGRAPH (Registered Trademark) RC Ink Black, manufactured by Riso Kagaku Corporation) was irradiated by an infrared laser beam having a diameter of 10 microns and a light output power of 20 mW radiated from a source distant from the surface of the polyester film by 20 mm, for 4 msec, such that the highest energy density portion of the laser beam is irradiated to the boundary between the film and the ink layer. As a result, the bore thus perforated had a diameter d1 at the front surface of 16–18 microns and diameter d2 at the rear surface of 18–20 microns.

Figure 3:
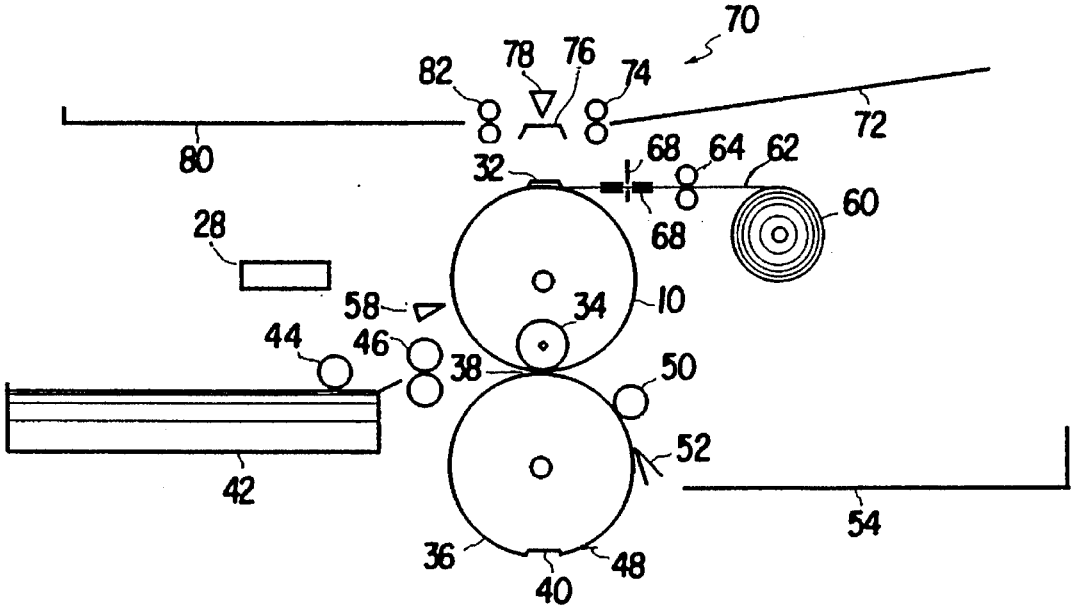
FIG. 3 is a diagrammatic front view showing an embodiment of the stencil printing device according to the present invention.
Figure 4:
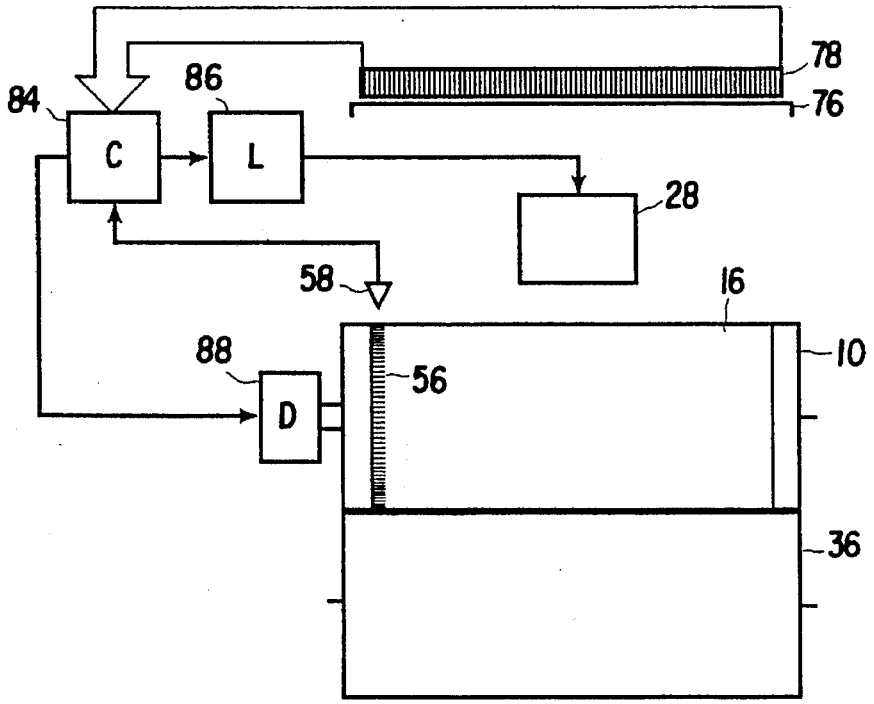
FIG. 4 is a diagrammatic side view of the stencil printing device shown in FIG. 3.

FIG. 3 is a diagrammatic front view showing an embodiment of the rotary stencil printing device embodying the method of perforating a stencil sheet according to the present invention, and FIG. 4 is a diagrammatic side view thereof. In these figures, 10 is a printing drum, a substantial portion of which is a cylindrical body which may be made of a net material woven from warp and weft wire materials as shown in FIG. 1. The printing drum 10 has a transverse bar member 32 extending along a generatrix thereof and equipped with an appropriate clamp means for mounting a leading edge of a stencil sheet. An inking roller 34 is provided within the printing drum 10 to be in contact with the inner circumferential surface of the cylindrical body and to supply ink thereto. A back press roller 36 is provided in parallel with the printing drum 10, so that the outer circumferential surfaces of the printing drum 10 and the back press roller 36 approach one another in the strip region along respective generatrices at mutually opposing portions thereof, so as thereby to define therebetween a nip region 38 for nipping a print sheet therebetween, the print sheet being given ink extruded through the perforations of the stencil sheet mounted around the printing drum 10, the ink adhering to the print sheet to produce a print. The printing drum 10, the inking roller 34 and the back press roller 36 are driven for rotation in synchronization with one another. In the shown embodiment, the printing drum 10 and the back press roller 36 have the same diameter as one another, and are rotated at the same rotation angular speed in the directions opposite to one another. The back press roller 36 is formed with a groove 40 at a portion of its outer circumferential surface along a generatrix thereof, said groove receiving therein the transverse bar member 32 6f the printing roller 10 when the transverse bar member traverses the nip region 38.

A print sheet supply means is provided, which includes a print sheet supply tray 42, a print sheet feed out roller 44, print sheet transfer roller pair 46, etc., and supplies print sheets one by one to the nip region 38 in synchronization with the rotation of the printing drum 10 and the back press roller 36. In the shown embodiment, the back press roller 36 has a print sheet clamp means as proposed in Japanese Patent Application 3-162218 filed by the same applicant as the assignee of the present invention. The print sheet clamp means includes a clamp means 48 mounted at a portion of the outer circumferential surface of the back press roller 36 along a generatrix thereof so as to hold a leading edge of a print sheet transferred toward the nip region 38 onto the back press roller 36, and a pair of press rollers 50 adapted to press opposite side edge portions of the print sheet passed through the nip region 38 onto the back press roller 36 so that the print sheet moves together with the back press roller as tightly held thereon. The clamp means 48 releases the leading edge of the print sheet when the leading edge has passed under the press rollers 50, and thereafter the print sheet is peeled off from the back press roller 36 by a claw means 52, starting from the leading edge thereof, so as to be finally received in a print sheet receiving tray 54.

Figure 5:
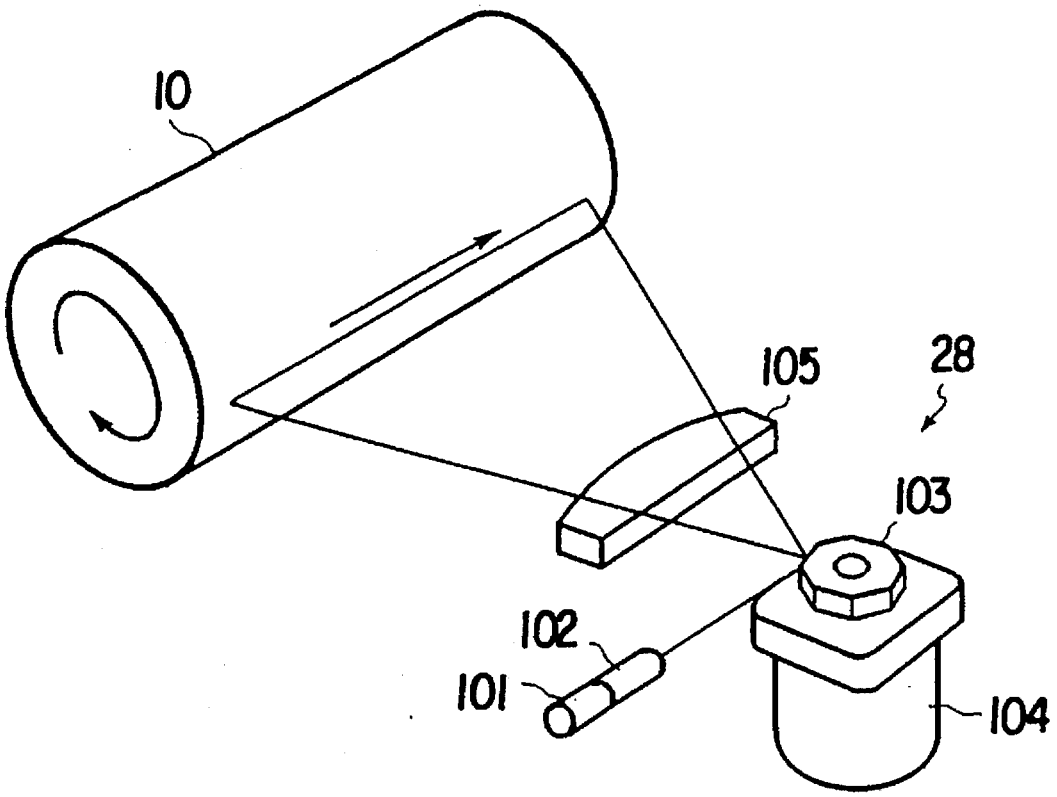
FIG. 5 is a diagrammatic perspective view showing a detail of the laser source means incorporated in the stencil printing device shown in FIGS. 3 and 4.

A laser source means 28 is provided to be distant from and to oppose the outer circumferential surface of the printing drum 10. The laser source means may be of a relatively small and low output power type such as a semiconductor laser device, and is adapted to radiate a laser beam from a tip portion thereof toward a thermal stencil sheet mounted around the outer circumferential surface of the printing drum 10. The laser source means 28 in the embodiment shown in FIGS. 3 and 4, may have a construction shown in FIG. 5, including a laser diode 101, a connection lens 102, a polygonal mirror 103, a scanner motor 104 for rotating the polygonal mirror and a deflection/collection lens 105, and is able to irradiate the laser beam generated by the laser diode 101 in a manner of scanning a line path along a generatrix of the printing drum 10 at high speed.

The stencil sheet 16 mounted around the printing drum 10 is provided with a pitch pattern 56 along one side edge thereof which is adapted to be optically read out by a pitch pattern read out means 58 provided adjacent the corresponding one end of the printing drum to face the outer circumferential portion thereof as spaced therefrom. The rotation angular position of the printing drum 10 can be recognized by the pitch pattern 56 being read out by the pitch pattern read out means 58. However, such pitch pattern and pitch pattern read out means are not essential. Each longitudinal position of the stencil sheet mounted around the printing drum may be recognized by detecting the rotational position of the printing drum by any known position detecting means or rotary angle detection means.

60 is a roll of a stencil sheet, from which a strip like stencil sheet 62 is drawn out and transferred by a pair of stencil sheet transfer rollers 64 to pass through a stencil sheet guide means 66, so that its leading edge is mounted to the transverse bar member 32 of the printing drum 10, and after a unit length of the stencil sheet has been mounted around the printing drum, the strip like stencil sheet is cut by a cutting means 68.

An original read out means 70 is provided above the printing drum to carry out a stencil printing based upon copying of an original. The original read out means 70 includes an original placing table 72, a pair of original transfer rollers 74 to nip and transfer the original placed on the original placing table starting from a leading end thereof, and an original read out head 78 such as an array of CCD elements for optically leading colored portions of the original transferred over an original read out table 76 to generate corresponding electrical signals, and a pair of original transfer rollers 82 for transferring the original toward an original receiving table 80 after it has been read out.

The original read out head 78 includes a large number of dot original read out elements arranged in an array to extend in the direction perpendicular to the direction in which the original is transferred by the original transfer rollers 74 and 82, to cover the full width of the original, and is adapted to read out the colored portions of the original as divided into a large number of data corresponding to the respective dot positions distributed over the full length of the original, at each instant while the original is being transferred under those dot original read out elements. In this case, the colored portions of the original are read out as on or off information with respect to each dot coordinate position of a two dimensional dot matrix based upon an ordinate according to a first dimension defined in the direction perpendicular to the direction of transfer of a rectangular original and an abscissa according to a second dimension defined in the direction of transfer of the rectangular-original.

A collection of each set of dot signals arranged along the abscissa at each ordinate position of the original thus obtained by the original read out head 78 is sent to a perforation control means 84 constructed by a computer. The perforation control means 84 is also supplied with a signal with respect to the rotation angular position of the printing drum 10 from the pitch pattern read out means 58, and constructs a pattern information of the colored portions of the original according to the above-mentioned two dimensional dot matrix data. After the original has been read out and an .image pattern according to the above-mentioned two dimensional dot matrix has been constructed, or before the construction of such an image pattern has been completed, each time when a set of abscissa data are obtained with respect to each ordinate position, the data signals are supplied to a laser source control means 86, which controls on and off operation of the laser source means 28 such that the laser beam is selectively radiated toward the printing drum 10 along a scanning path extending along a generatrix thereof. In the meantime, the printing drum 10 is driven by a rotary drive means 88 based upon an instruction signal dispatched from the perforation control means 84 to rotate the printing drum at a speed higher than that during the printing process. Prior to such a high speed rotation of the printing drum 10, the inking roller 34 and the back press roller 36 are retracted from the inner circumferential surface and the outer circumferential surface of the printing drum, respectively, by respective control means not shown in the figure.

Thus, the stencil sheet mounted around the outer circumferential surface of the printing drum 10 is perforated according to the image recognized by dividing the colored portions of the original into two dimensional dot matrix data.

Figure 6:
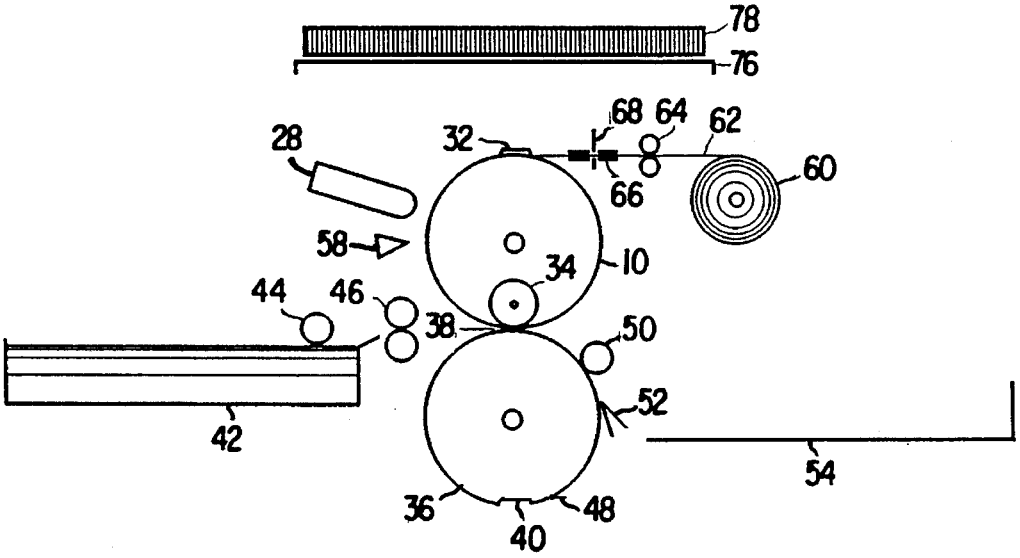
FIG. 6 is a diagrammatic front view showing another embodiment of the stencil printing device according to the present invention.
Figure 7:
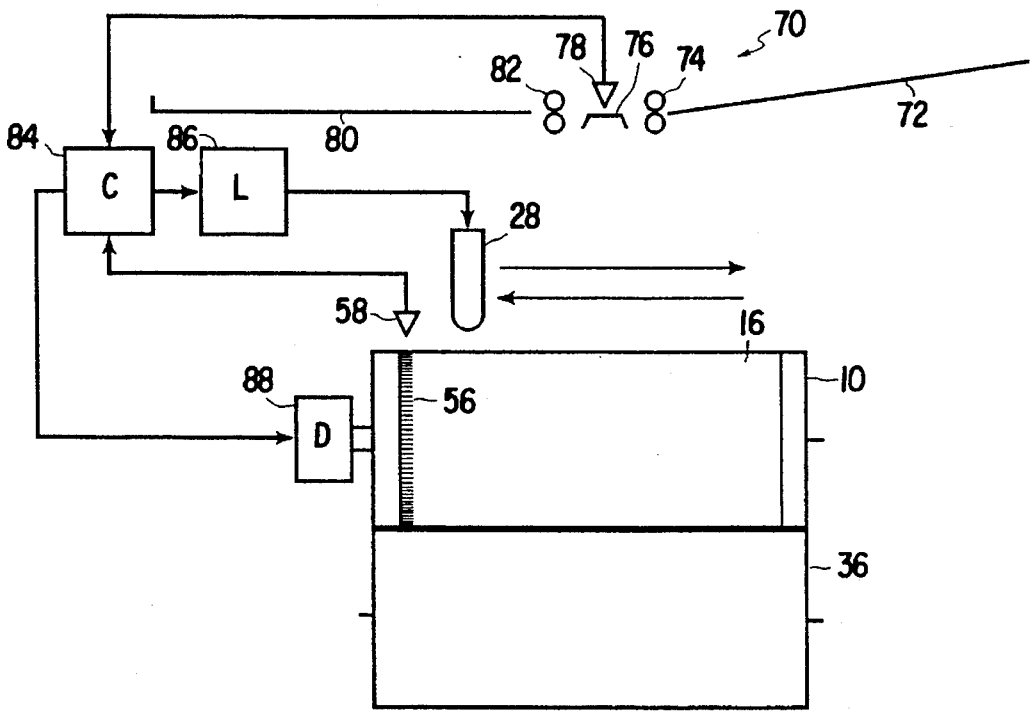
FIG. 7 is a diagrammatic side view of the stencil printing device shown in FIG. 6.

FIGS. 6 and 7 are diagrammatic front and side views similar to FIGS. 3 and 4, respectively, showing another embodiment of the stencil printing device according to the present invention. In FIGS. 6 and 7, the portions corresponding to those shown in FIGS. 3 and 4 are designated by the same reference numerals.

In the embodiment shown in FIGS. 6 and 7, in recognizing colored portions of a rectangular original based upon a two dimensional dot matrix defined by an abscissa extending in the direction of a generatrix of the printing drum and an ordinate extending in the circumferential direction of the printing drum, the original read out means 70 transfers the original in the transverse direction by similar original transfer rollers 74 and 82, while a dot original read out head 78 including an array of dot read out elements arranged in the longitudinal direction of the original read out the colored portions of the original to produce a set of dot read out data at each instant when the plurality of dot original read out elements traverse each abscissa position of the original, so as to supply corresponding two dimensional data signals to the perforation control means 84. In this case, the perforation of the stencil sheet mounted on the printing drum 10 by a similar laser source means 28 can be carried out such that the stencil sheet is irradiated by a laser beam according to a series of dot signals arranged along the ordinate at each abscissa position during each one rotation of the printing drum. Therefore, the combination of the laser diode 101 and the connection lens 102 may be simply mechanically moved pitch by pitch along the central axis of the printing drum, as shown in FIG. 7, without requiring such a high speed deflection of the laser beam by a rotary polygonal mirror used in the embodiment shown in FIG. 5. Therefore, the distance of irradiation of the laser beam is shortened, and the rate of focusing the beam is correspondingly increased.

It will be apparent that, in each embodiment shown in FIGS. 3–7, when the stencil printing is carried out based upon image signals received from a word processor or an image processing computer, instead of the printing based upon copying of an original, the stencil sheet can be perforated on the printing drum 10 by operating the laser source means 28 shown in FIGS. 3–5 or FIGS. 6–7 in the same manner by such electronic image signals being directly input to the perforation control means 84.

The above-mentioned light absorbing heat generating substance will guarantee the perforation of the stencil sheet by a low energy laser beam according to the present invention may not only be the carbon black in the above-mentioned embodiment but also may be other substances, particularly when an infrared laser beam is used, such as polymethine type, phthalocyanine derivatives type, dithiol metal complex type, naphthoquinone or anthraquinone derivatives type, and aminium or diaminium type substances, according to the frequency range of the laser beam.

As an example, a polymethine type color substance (trademark: "KAYASORB IR-820B", manufactured by Nippon Kayaku Co., Ltd.) was added to a blue emulsion ink (trademark: "RISOGRAPH RC Ink Blue", manufactured by Riso Kagaku Corporation) at a ratio of 1.0 wt %, and the mixture was painted to a rear surface of a polyester film having 2.0 microns thickness and a thermal shrinkage value of 7.5% according to one minute dip in a silicon oil of 120° C., and the film thus prepared was irradiated by an infrared laser beam having a diameter of 10 microns and a light output power of 20 mW, for 4 msec, from a position remote from the front surface of the film by 20 mm, such that a portion of the light beam having the highest energy density coincides with the boundary between the film and the ink layer. As a result, a bore was formed in the film, which, as viewed in the section shown in FIG. 2B, had the diameter d1 of 16 microns and the diameter d2 of 18 microns.

Although the present invention has been described in detail in the above with respect to the two preferred embodiments thereof, it would be apparent for those skilled in the art that various other embodiments are possible within the scope of the present invention. Particularly, the present invention is not restricted to stencil printing by the rotary stencil printer but may be applied to various known stencil printing devices. Further, the present invention is not restricted to the use of the thermal stencil sheet combined with a perforated supporting sheet material, but a free layer of a heat-sensitive plastic film or a multi-layered sheet of heat-sensitive plastic films may be used.

As will be appreciated from the foregoing detailed descriptions of the invention, the present invention is liberated from the conventional basic technical concept considered to be a matter of course in such printing art using a master as the stencil printing or intaglio printing that the master be inked after it has been finished. Thus, in stencil printing by a heat-sensitive stencil sheet, by the stencil sheet being supplied with ink containing a light absorbing heat generating substance prior to the perforation thereof, the invention has made it possible to prepare a stencil master by a laser beam having a low energy density available by a relatively small and convenient laser means such as a semiconductor laser. Further, since the layer of the ink containing a light absorbing heat generating substance supplied to the stencil sheet prior to the perforation can be used as it is in the printing process following to the perforation process, the process of inking the stencil sheet is highly rationalized. Further, when the supporting and the inking for the stencil sheet for the purpose of perforation are provided by the printing drum of a rotary stencil printer, no separate means is required for supporting the stencil sheet for the perforation. When the perforation of the stencil sheet is carried out on the printing drum of a rotary stencil printer, the inking roller and the back press roller which engage the printing drum during the printing process may be temporarily disengaged from the contact with the printing drum, whereby the printing drum can be rotated at much higher rotation speed than in the printing process, so that the process of perforation of the stencil sheet can be carried at high speed under no contact technique by a laser beam.

I claim:

1. A method for perforating a thermal stencil sheet by a laser beam, comprising the steps of providing a source of a laser beam, positioning a thermal stencil sheet so that a heat-sensitive plastic film thereof faces said source of a laser beam with a first surface thereof, supplying a layer of ink including a light absorbing heat generating substance to a second surface of the heat-sensitive plastic film opposite to said first surface, irradiating the laser beam from said source to the heat-sensitive plastic film from the side of said first surface, and melting and perforating the heat-sensitive plastic film starting from said second surface by heat generated in the light absorbing heat generating substance of the ink layer by the laser beam passing through the heat-sensitive plastic film and being absorbed by the light absorbing heat generating substance.

2. A method for carrying out stencil printing by a rotary stencil printer having a printing drum adapted to support a stencil sheet on an outer circumferential surface thereof and to supply ink to a rear surface of the stencil sheet supported on said outer circumferential surface and a source of a laser beam, comprising the steps of mounting a heat-sensitive stencil sheet prior to perforation thereof onto the outer circumferential surface of the printing drum, supplying a layer of ink containing a light absorbing heat generating substance to the rear surface of the stencil sheet mounted on said outer circumferential surface of said printing drum such that the stencil sheet is adhesively held by said ink layer, irradiating a laser beam from said source to a portion of the stencil sheet to be perforated such that the stencil sheet is adhesively held on the printing drum by said ink layer, melting and perforating said stencil sheet starting from the rear surface thereof by heat generated in the light absorbing heat generating substance of the ink layer by the laser beam passing through said stencil sheet and absorbed by the light absorbing heat generating substance, and carrying out stencil printing by the stencil sheet continuously held on the printing drum after having been perforated.

3. A method of stencil printing according to claim 2, wherein the step of melting and perforating said stencil sheet comprises the step of rotating the printing drum while adhesively holding the stencil sheet by means of said ink layer while shifting a position of irradiation of the laser beam on the stencil sheet along a central axis of the printing drum.

4. A method of stencil printing according to claim 3, wherein, in copy printing of an original, denoting the orientation of a generatrix of the outer circumferential surface of the printing drum as a lateral orientation of the stencil sheet, and the circumferential orientation of the outer circumferential surface of the printing drum as a longitudinal orientation of the stencil sheet, further comprising the steps of providing a plurality of dot read out means arranged in said lateral orientation, reading out the original by said plurality of dot read out means into two dimensional dot matrix image data with the original being transferred in the longitudinal direction such that each set of lateral dot image data are obtained corresponding to each longitudinal position of the original, and operating said source to selectively activate the laser beam to irradiate onto the stencil sheet mounted on the outer circumferential surface of said printing drum according to each said set of lateral dot image data at each position along said longitudinal orientation.

* * * * *